United States Patent [19]

Haas et al.

[11] 4,103,860

[45] Aug. 1, 1978

[54] MIRROR HOLDER

[76] Inventors: Charles A. Haas; John E. Schenken, both of 420 E. Grand Ave., Des Moines, Iowa 50309

[21] Appl. No.: 768,285

[22] Filed: Feb. 14, 1977

[51] Int. Cl.[2] ..... A47G 1/17

[52] U.S. Cl. ..... 248/467; 40/152.1; 40/154; 224/29 A; 248/475 R; 296/97 B

[58] Field of Search ..... 248/467, 466, 468, 475 R, 248/314, 205 A, 214, 215, 220.2, 226.5; 350/277, 307; 132/83 E; 40/10 A, 10 B, 10 D, 64 R, 152.1, 154; 224/29 A; 296/97 B

[56] References Cited

U.S. PATENT DOCUMENTS

| | | | |
|---|---|---|---|
| 1,698,266 | 1/1929 | Kirby | 132/83 E |
| 2,068,083 | 1/1937 | Souter | 40/154 X |
| 2,097,419 | 10/1937 | Schmidt | 248/475 R X |
| 2,194,758 | 3/1940 | La Hodny et al. | 248/475 R X |
| 2,931,612 | 4/1960 | Grabber | 248/214 |
| 3,364,603 | 1/1968 | Tate | 40/10 D |
| 3,410,513 | 11/1968 | Wolf | 248/467 X |
| 3,588,233 | 6/1971 | Lambert | 248/475 R X |
| 3,771,246 | 11/1973 | Ebner | 40/152.1 |
| 3,918,187 | 11/1975 | Vogele | 40/152.1 X |

*Primary Examiner*—Rodney H. Bonck
*Attorney, Agent, or Firm*—Zarley, McKee, Thomte, Voorhees & Sease

[57] ABSTRACT

A mirror holder comprises a molded support structure of relatively rigid material yet sufficiently flexible to bend under stress, having a front and back wall with a slot therebetween for securing a mirror therebetween, the slot having one open end for slidably receiving the mirror, one of the walls having at least one node at the open end of the slot for blocking the open end and holding the mirror in place, the front wall having an opening therein exposing the mirror and providing a frame for the mirror, clamps detachably secured to the back wall of the support structure for mounting the mirror holder on an automobile visor, and adhesive strips located on the back wall of the support structure for alternatively mounting the mirror holder.

8 Claims, 7 Drawing Figures

MIRROR HOLDER

BACKGROUND OF THE INVENTION

This invention relates to a mirror holder of basically one piece construction. Many mirror and card holding devices have been previously provided but these devices are of multiple piece construction and use frictional methods to hold card or mirror in place.

It is a principal object of the invention to provide a unitary one piece construction mirror holder.

A still further object of the invention is to provide a mirror holder that is easily assembled by merely inserting the mirror.

A still further object of the invention is to provide a mirror holder that holds the mirror firmly in place yet allows replacement of the mirror.

A still further object of the invention is to provide a mirror holder that offers alternative methods of mounting.

A still further object of the invention is to provide a mirror holder which is economical to manufacture, durable in use and refined in appearance.

SUMMARY OF THE INVENTION

A mirror holder is disclosed wherein a molded support structure is provided having a front and back wall with a slot therebetween for receiving and securing a mirror therebetween. The slot has one open end for slidably detachably receiving the mirror, and one of the walls has at least one node at the open end of the slot for blocking the open end and holding the mirror in place. The front wall has an opening therein to form a frame around the mirror's edge. Clamps are provided on the back wall of the molded support structure for mounting the mirror holder to an automobile visor. Adhesive strips are also provided on the back wall for alternatively mounting the mirror holder by adhesion.

DESCRIPTION OF THE PREFERRED EMBODIMENT

Figure 1:
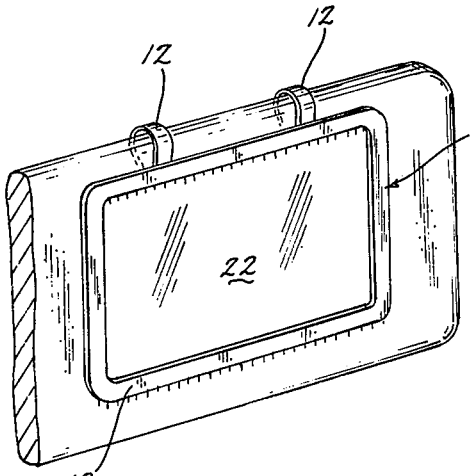
FIG. 1 is a perspective view of the invention mounted to an automobile visor by clamps.

The mirror case 10 of FIG. 1 is generally comprised of visor clamps 12 and molded support structure 14.

Figure 2:
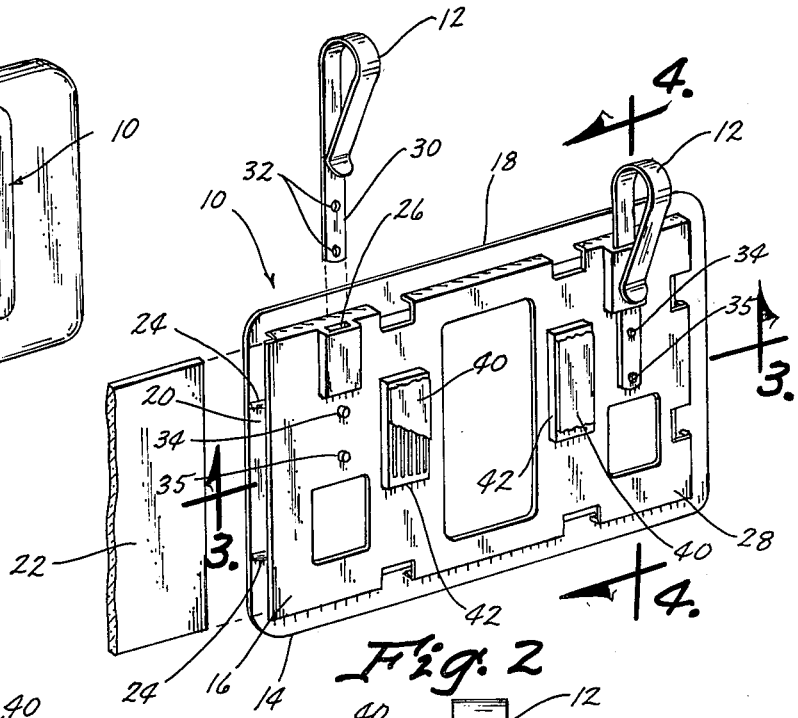
FIG. 2 is a partially exploded perspective rear view of the invention.
Figure 3:
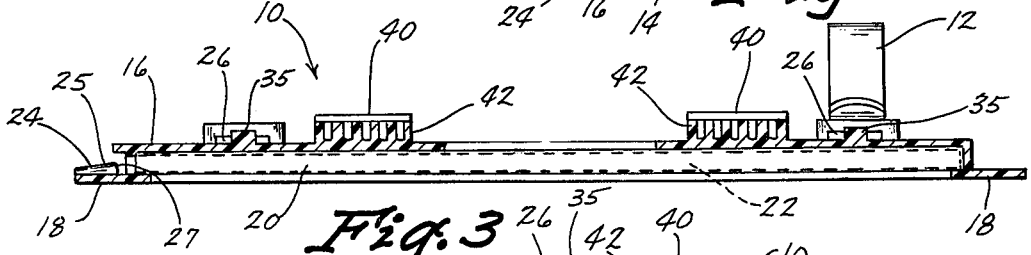
FIG. 3 is an enlarged sectional view seen on line 3—3 of FIG. 2.
Figure 5:
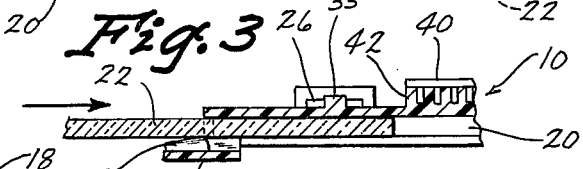
FIG. 5 is a partial view of FIG. 3 illustrating the mirror being placed in the holder.

Molded support structure 14 is of one piece construction, preferably of relatively rigid plastic having a back wall 16 and a front wall 18. Slot 20, between front wall 18 and back wall 16, receives and houses mirror 22 as shown in FIGS. 3 and 5. Slot 20 is of sufficient thickness to snugly house mirror 22, yet allow easy insertion of mirror 22. Nodes 24 located on the back of front wall 18 and at the entrance to slot 20 as shown in FIGS. 2 and 3, lock in mirror 22 and prevent it from sliding out once it is completely inserted into slot 20. Nodes 24 each include an inclined surface 25 and a vertical shoulder 27 so that the mirror will cam against surface 25 during insertion to cause outward flexing of front wall 18. Upon partial insertion of the mirror, as shown in FIG. 5, the front wall 18 buckles out slightly depressing nodes 24 away from back wall 16 and allowing easy insertion of mirror 22. When mirror 22 is completely inserted, and past nodes 24, front wall 18 returns to its normally flat position and shoulders 27 of nodes 24 lock in mirror 22 as shown in FIG. 3.

Figure 4:
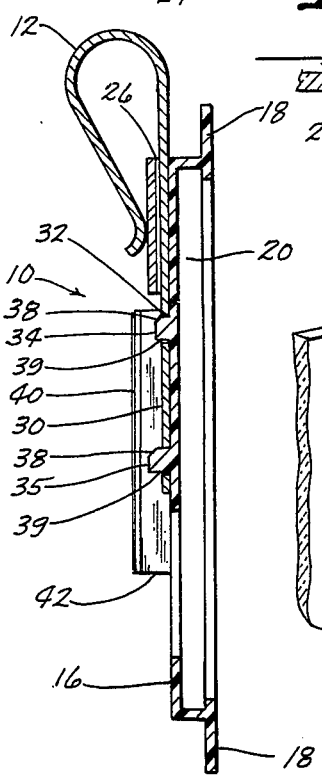
FIG. 4 is an enlarged sectional view seen on line 4—4 of FIG. 2.

Shanks 30 of visor clamps 12 include apertures 32 as shown in FIG. 2, and are received by channels 26 located on the upper portion of back face 28 of back wall 16. Posts 34 and 35 are located on back face 28 directly beneath channels 26 such that upon insertion of visor clamps 12 to channel 26, posts 34 and 35 are received by apertures 32 firmly securing visor clamp 12 in place. Posts 34 and 35 have inclined surfaces 38 as shown in FIG. 4 to facilitate sliding shank 30 over posts 34 and 35 to alignment with apertures 32. Post 34 is slightly shorter than post 35 to facilitate insertion of shank 30 yet still provide secure attachment of visor clamp 12. Posts 34 and 35 also include vertical locking shoulders 39 for locking shanks 30 in place. Visor clamps 12 provide a quick, convenient means to firmly secure mirror case 10 to an automobile visor as shown in FIG. 1.

Figure 6:
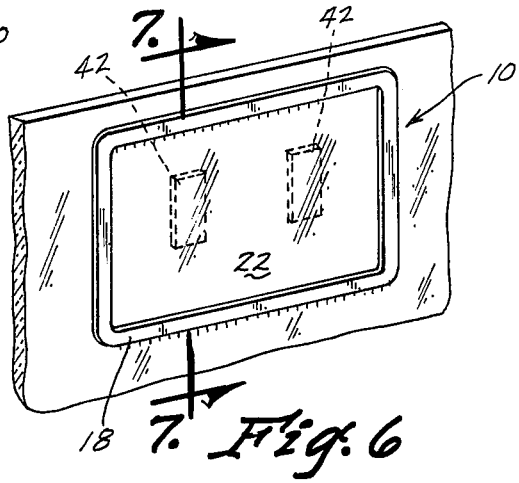
FIG. 6 is a perspective view of the invention illustrating mounting to an automobile visor by adhesive material with the broken lines indicating the adhesive material.
Figure 7:
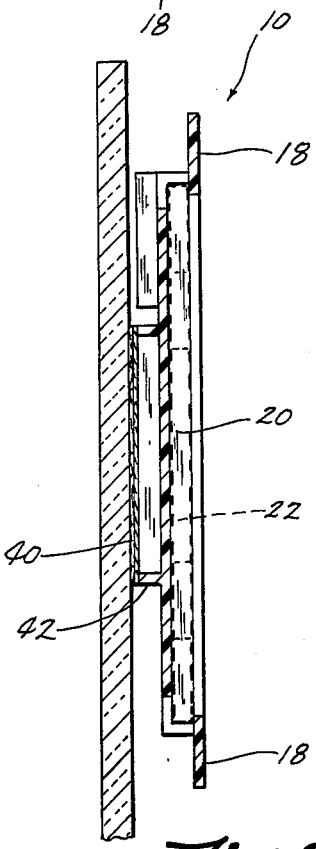
FIG. 7 is an enlarged sectional view seen on line 7—7 of FIG. 6.

An alternative adhesive method of attachment of mirror case 10 is also provided as shown in FIGS. 6 and 7. Adhesive material 40 is attached to adhesive mounts 42 located on back face 28 as shown in FIGS. 2 and 3. Adhesive material 40 is of the conventional type such that when mirror case 10 is to be mounted, the protective cover of adhesive material is removed and the case is firmly pressed against the visor or mounting surface.

Molded support structure 14 can be of various sizes and shapes to facilitate different types of mirrors such as round cosmetic mirrors.

As can be seen, mirror case 10 is easy to assemble in that mirror 22 easily slides into place as do visor clamps 12. Mirror case 10 is of rugged construction and firmly holds mirror 22 to reduce the possibility of breakage. Mirror case 10 also provides easy alternative methods of attachment in visor clamps 12 and adhesive material 40. This mirror case 10 is a novel mirror holder that accomplishes at least all of its stated objectives.

What is claimed is:

1. A mirror holder comprising, a molded support structure having a front and back wall with a slot therebetween having one open end for slidably removably receiving a mirror therethrough for securement between said front and back walls, said slot having lateral edges, one of said front and back walls having at least one node at said open end of said slot for blocking said open end and holding said mirror in place;

said node being spaced inwardly from said lateral edges and having an angularly disposed camming surface positioned to engage said mirror and cam said mirror outwardly away from said one wall during insertion, the other of said front and back walls having sufficient flexibility to be flexed outwardly away from said one wall in response to said camming action of said mirror against said camming surface of said node during insertion;

said front wall having an opening therein exposing said mirror; and means associated with said support structure for attaching said support structure to another supporting surface.

2. The device of claim 1 wherein said front and back walls each have adjacent sides arranged in generally parallel closely spaced relation, said support structure including an opposite at least partially closed end and means for securing together said adjacent sides of the front and back walls to prevent removal of the mirror therethrough, said node including a shoulder for retentively engaging said mirror when said mirror is within said slot.

3. The device of claim 2 wherein said node includes an angularly disposed camming surface arranged outwardly of said shoulder such that the mirror, upon insertion into said slot, cams against said camming surface to cause flexing of said one wall away from the other wall.

4. The device of claim 3 wherein said one wall has sufficient resiliency to snap back to its original position after said mirror is inserted into said slot past said node, whereby said shoulder of said node will retentively engage the end of said mirror within said slot.

5. The device of claim 4 wherein said one wall, with a mirror fully inserted within said slot, is adapted to be flexed away from said other wall upon manual pressure against said node to move said node out of blocking relation at the open end of the slot and thereby provide for the removal of said mirror through said open end.

6. The device of claim 1 wherein said back wall has a front face facing said front wall and an opposite back face, said means for attaching said support structure comprising at least one channel on said back face, at least one post on said back face directly beneath said channel and in spaced relation therefrom, and a clamp having a shank slidably receivable within said channel along said back face, said shank having a clamp arm at one end, said clamp arm folded back onto the shank and biased toward the shank to engage said supporting surface therebetween, said shank having a plurality of apertures adjacent the opposite end thereof for releasably receiving and locking onto a post when said shank is slidably received within said channel.

7. The device of claim 6 wherein said post includes a beveled surface on the side facing said channel for causing camming movement of said shank over said post during insertion of said shank into said channel and a non-beveled locking shoulder on the opposite side thereof for engaging a sidewall of one of said apertures.

8. The device of claim 7 including a pair of posts arranged on said back face in spaced-apart relation longitudinally of said channel for insertion into respective apertures of said clamp shank, the post closer to said channel being shorter than the other post to facilitate movement of said shank over said first post and onto said second post.

* * * * *